US010532902B2

(12) United States Patent
Motz et al.

(10) Patent No.: US 10,532,902 B2
(45) Date of Patent: Jan. 14, 2020

(54) SYSTEM AND METHOD FOR ROLLING UP A FLEXIBLE SHEET

(71) Applicants: James G. Motz, Cincinnati, OH (US); Matthew J. Motz, Cincinnati, OH (US)

(72) Inventors: James G. Motz, Cincinnati, OH (US); Matthew J. Motz, Cincinnati, OH (US)

(73) Assignee: MOTZ ENTERPRISES, INC., Cincinnati, OH (US)

( * ) Notice: Subject to any disclaimer, the term of this patent is extended or adjusted under 35 U.S.C. 154(b) by 204 days.

(21) Appl. No.: 15/497,815

(22) Filed: Apr. 26, 2017

(65) Prior Publication Data

US 2017/0313534 A1 Nov. 2, 2017

Related U.S. Application Data

(60) Provisional application No. 62/329,560, filed on Apr. 29, 2016.

(51) Int. Cl.

| | |
|---|---|
| ***B65H 18/16*** | (2006.01) |
| ***E02D 17/20*** | (2006.01) |
| ***E02B 3/12*** | (2006.01) |

(52) U.S. Cl.

CPC ..... *B65H 18/16* (2013.01); *E02B 3/121* (2013.01); *E02D 17/202* (2013.01); *B65H 2701/1922* (2013.01); *E02B 3/122* (2013.01)

(58) Field of Classification Search

CPC .. E02B 3/121; E02B 3/122; B65H 2701/1922
See application file for complete search history.

(56) References Cited

U.S. PATENT DOCUMENTS

| | | | | |
|---|---|---|---|---|
| 3,053,328 | A | 9/1962 | Geipel | |
| 3,429,377 | A | 2/1969 | Nunes | |
| 4,084,763 | A | 4/1978 | Zamboni | |
| 4,890,801 | A | 1/1990 | Brouwer | |
| 4,892,153 | A | 1/1990 | Cooling | |
| 5,129,462 | A * | 7/1992 | Mail | A01G 20/12 172/19 |
| 5,857,527 | A | 1/1999 | Van Vuuren | |

(Continued)

FOREIGN PATENT DOCUMENTS

| | | |
|---|---|---|
| CA | 2201660 | 10/1998 |

OTHER PUBLICATIONS

Product Information featuring "3414 Series Multi-Spindle Rotary Cutters" by Bush Hog®, www.bushhog.com/catalog/rotary-cutters-crop-shredders/multi-spindle-rigid-deck-series/3414-series-rotary-cutters/ (at least as early as 2016).

(Continued)

*Primary Examiner* — Sang K Kim
(74) *Attorney, Agent, or Firm* — Thompson Hine LLP

(57) ABSTRACT

A system for rolling up a flexible sheet may include a frame; a friction element mounted on the frame, the friction element having an endless friction outer surface with a sheet-engaging portion positioned to engage an end of the flexible sheet lying in a substantially horizontal position relative to the frame; and a drive connected to the friction element to move the endless friction outer surface such that the sheet-engaging portions thereof move upwardly to engage the end of the flexible sheet and lift up and roll the end of the flexible sheet over on itself to form a roll.

13 Claims, 12 Drawing Sheets

(56) References Cited

U.S. PATENT DOCUMENTS

| | | | |
|---|---|---|---|
| 6,273,196 | B1 | 8/2001 | Van Vuuren |
| 6,793,858 | B2 | 9/2004 | Motz |
| 2015/0225195 | A1 | 8/2015 | Bishop |

OTHER PUBLICATIONS

Product Information featuring "IC-35 Crawler Carrier" by IHI Construction Machinery, www.ihicompactexcavator.com/product/ic-35-crawler-carrier/ (at least as early as 2016).
Product Information featuring "Bobcat Model S175 Skid-Steer Loader", http://d3is8fue1tbsks.cloudfront.net/PDF/Bobcat/Bobcat%20S175%20Skidsteer.PDF (Mar. 11, 2008).
PCT, International Search Report and Written Opinion, International Application No. PCT/US2017/029617 (dated Oct. 2, 2017).
PCT, Invitation to Pay Additional Fees, International Application No. PCT/US2017/029617 (dated Apr. 26, 2017).
AU, Australian Patent Examination Report No. 1, Australian Patent Application No. 2017257882 (dated May 6, 2019).

* cited by examiner

SYSTEM AND METHOD FOR ROLLING UP A FLEXIBLE SHEET

TECHNICAL FIELD

The disclosure relates to systems and methods for forming flexible sheets of material into a roll, and more particularly, to systems and methods for rolling up a flexible mat of erosion-prevention material.

BACKGROUND

Erosion is a natural process in which meteorological elements such as rain, wind, and snow remove soil, rock, and dissolved material from one location on the Earth's crust and transport it to another location. Although erosion is a natural process, human activity may increase the rate at which erosion occurs in a localized area to many times the rate at which it would otherwise occur. For example, land surfaces adjacent man-made structures, such as the land adjacent roads, reservoirs, and artificially created waterways such as canals and drainage channels, are particularly susceptible to erosion because naturally occurring indigenous vegetation is removed in order to form the road shoulder, reservoir bank, canal bank, or drainage channel bank.

Erosion can be mitigated in these areas by remediation of the land surface adjacent the canal, road, or waterway by planting vegetation to replace the vegetation that was stripped away during construction of such man-made structures. However, there is a time interval between the planting of the replacement vegetation and the point at which the replacement vegetation is sufficiently dense and rooted to prevent further erosion of surface soil during which further erosion may occur.

Efforts have been made to retain the surface soil in place in these areas until such time as the replacement vegetation can mature to the point where the root structure and density of the replacement vegetation is sufficient to retain the surface soil in place. An example of such material is the flexible mat disclosed in U.S. Pat. No. 6,793,858 titled "Method and Apparatus for Forming a Flexible Mat Defined by Interconnected Concrete Panels," the entire contents of which are incorporated herein by reference. That patent discloses a flexible mat in the form of spaced, interconnected concrete panels or blocks held together by an open mesh of a polymeric material such as a geo-grid.

The flexible mat is made by depositing concrete into rows of mold cavities of a rotating drum and embedding an open-mesh geo-grid into the concrete material in the cavities. The rotating drum lays the geo-grid material, embedded into the concrete panels or blocks, in the form of a flexible, elongate mat, on a horizontal surface, such as the ground. When formed, the flexible mat of this construction may be 4 to 20 feet in width and over 5,000 feet in length for a single continuous run of material.

In order to transport the flexible mat to the location where it is to be installed, it is necessary to cut the flexible mat into shorter length mats and then roll the shorter length mats into compact, coiled rolls that are placed on the flat beds of trucks, or in the trailer of a tractor trailer rig, or in the bed of a pickup truck by telehandlers and transported to the location of installation. Because the shorter length mats are comprised of a grid arrangement of concrete panels or blocks, the coiled rolls can be very heavy and the process of forming the coiled rolls by rolling up the mat can be labor intensive.

Accordingly, there is a need for a device that will roll lengths of flexible mat material into coiled rolls in an efficient and safe manner with a minimum of manual labor required.

SUMMARY

The present disclosure is a system and method for rolling up a flexible mat or sheet into a coil that can be placed on a truck bed and transported easily to an area where it is to be installed and unrolled. In one exemplary embodiment, a system for rolling up a flexible sheet includes a frame; a friction element mounted on the frame, the friction element having an endless friction outer surface with a sheet-engaging portion positioned to engage an end of the flexible sheet lying in a substantially horizontal position relative to the frame; and a drive connected to the friction element to move the endless friction outer surface such that the sheet-engaging portions thereof move upwardly to engage the end of the flexible sheet and lift up and roll the end of the flexible sheet over on itself to form a roll.

In another exemplary embodiment, a system for rolling up a flexible sheet includes a movable frame having first and second elongate guide walls, a transverse beam connected to the first and second guide walls such that the first and second guide walls are spaced apart sufficiently to straddle the sheet, the frame including wheels supporting the guide walls; an axle rotatably mounted on the frame and extending between the first and the second guide walls; a plurality of discs mounted on the axle, the plurality of discs optionally joined at outer peripheries thereof by a plurality of axially extending bars, the outer peripheries and optionally the bars forming an endless friction outer surface with a sheet-engaging portion positioned to engage an end of the flexible sheet when lying in a substantially horizontal position relative to the frame; a motorized cab attached to a side of the frame, the cab having front and rear axles extending across the cab and the frame, each of the front and rear axles having wheels mounted on an outboard side of the cab on one end and on an outboard side of the frame on an opposite end, wherein at least one of the front and rear axles is driven; the motorized cab having a drive motor connected to rotate the axle and the plurality of discs and thereby rotate the friction wheels to move the endless friction outer surfaces of the plurality of friction elements such that the sheet-engaging portions thereof move upwardly so that the end of the flexible sheet is lifted up and rolled over on itself to form a roll by engaging the sheet-engaging portions.

In yet another exemplary embodiment, a method for rolling up a flexible sheet includes placing the flexible sheet unrolled and flat on a substantially horizontal surface; rotating a plurality of friction elements, each of the plurality of friction elements having an endless friction outer surface with a sheet-engaging portion, such that the sheet-engaging portions thereof move upwardly from the horizontal surface; bringing the plurality of rotating friction elements into engagement with an end of the flexible sheet such that the upward movement of the sheet-engaging portions causes the end of the flexible sheet to curl upwardly over a remainder of the sheet to begin the rolling up of the flexible sheet; and moving the plurality of rotating friction elements in a direction toward the remainder of the flexible sheet, thereby causing the remainder of the flexible sheet to roll up into a spiral configuration.

Other objects and advantages of the disclosed system and method for rolling up a flexible sheet will be apparent from the following description, the accompanying drawings, and the appended claims.

DETAILED DESCRIPTION

Figure 1:
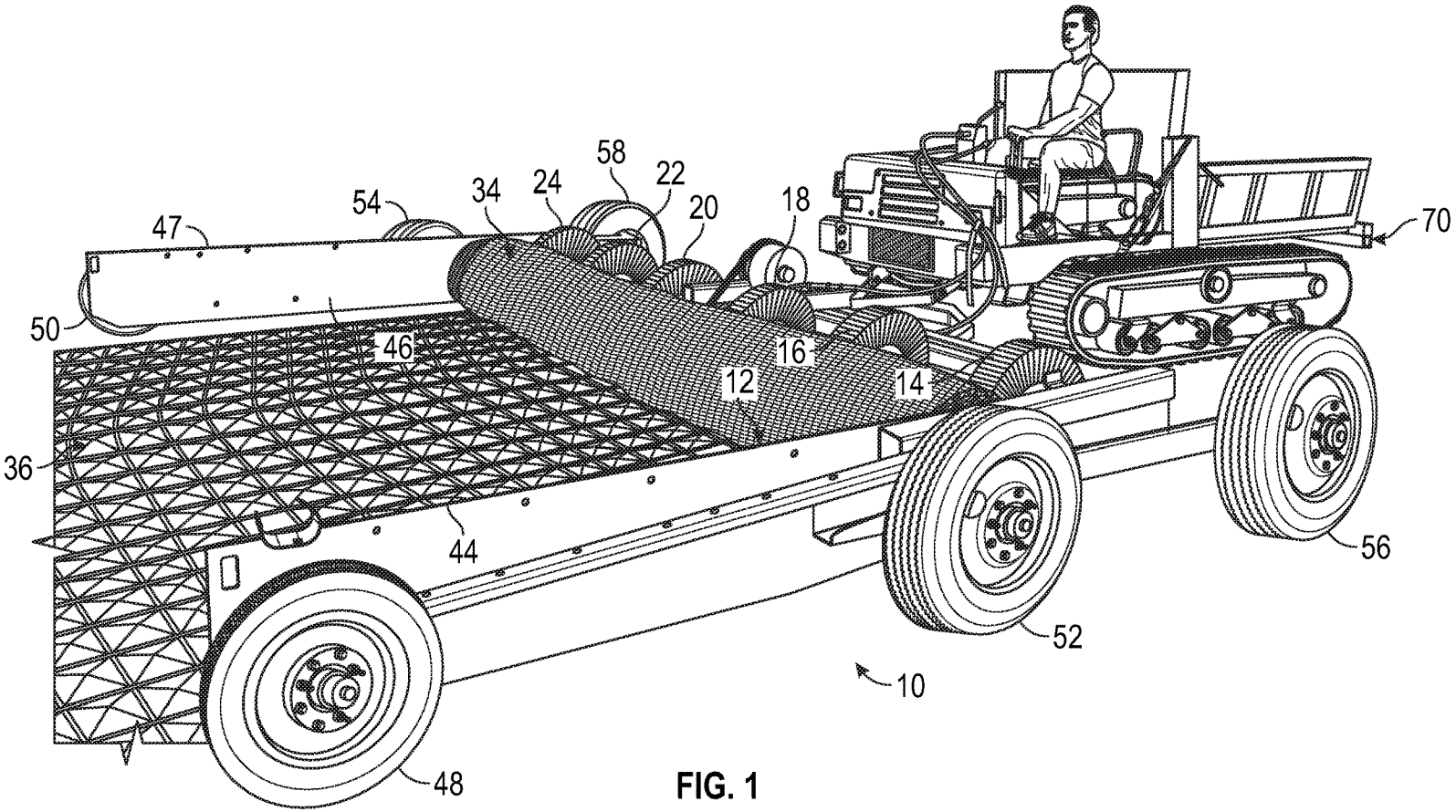
FIG. 1 is a perspective view of an embodiment of the system for rolling up a flexible sheet, taken from the front.
Figure 2:
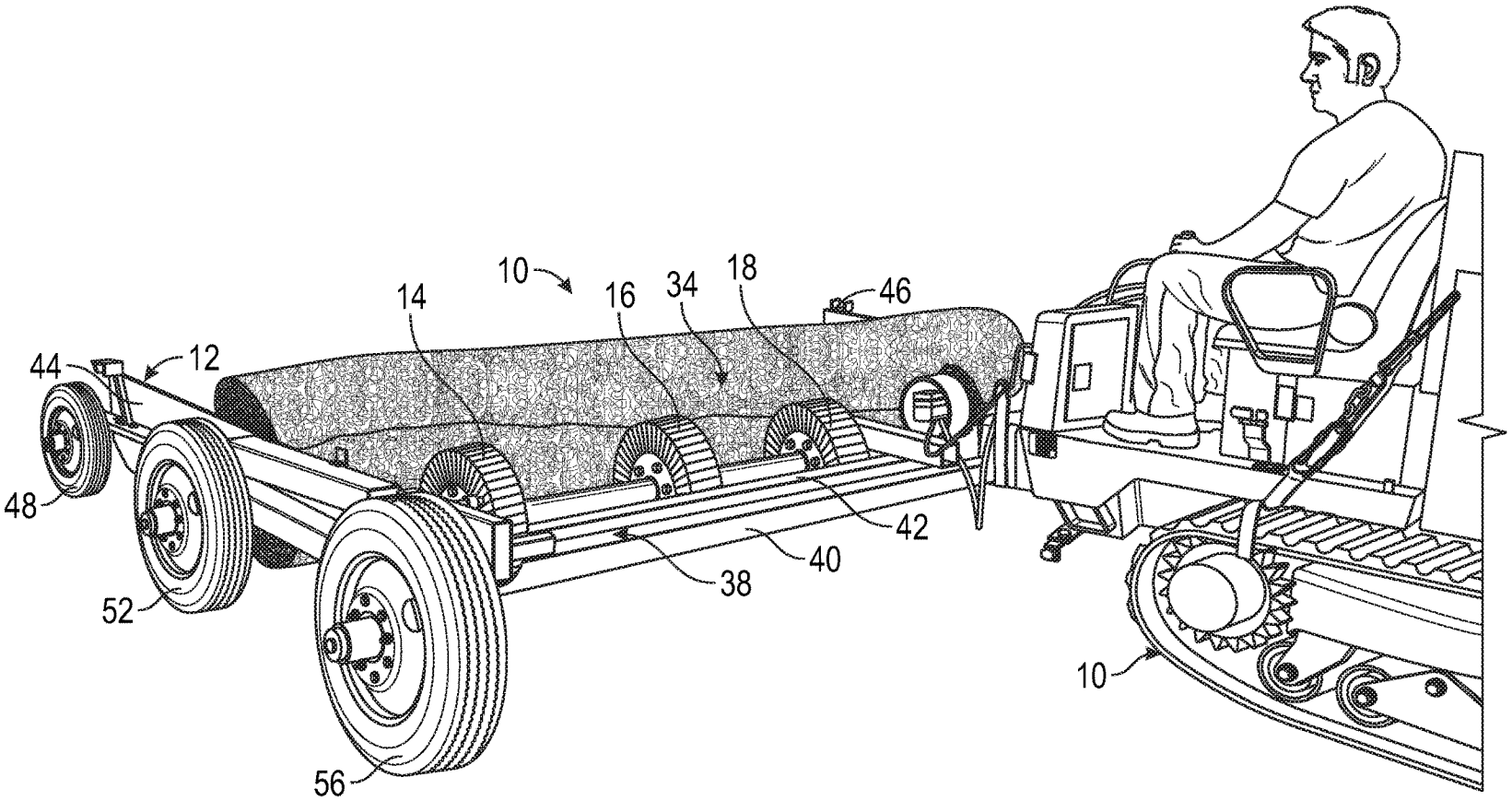
FIG. 2 is a perspective view of the system of FIG. 1, taken from the rear.
Figure 3:
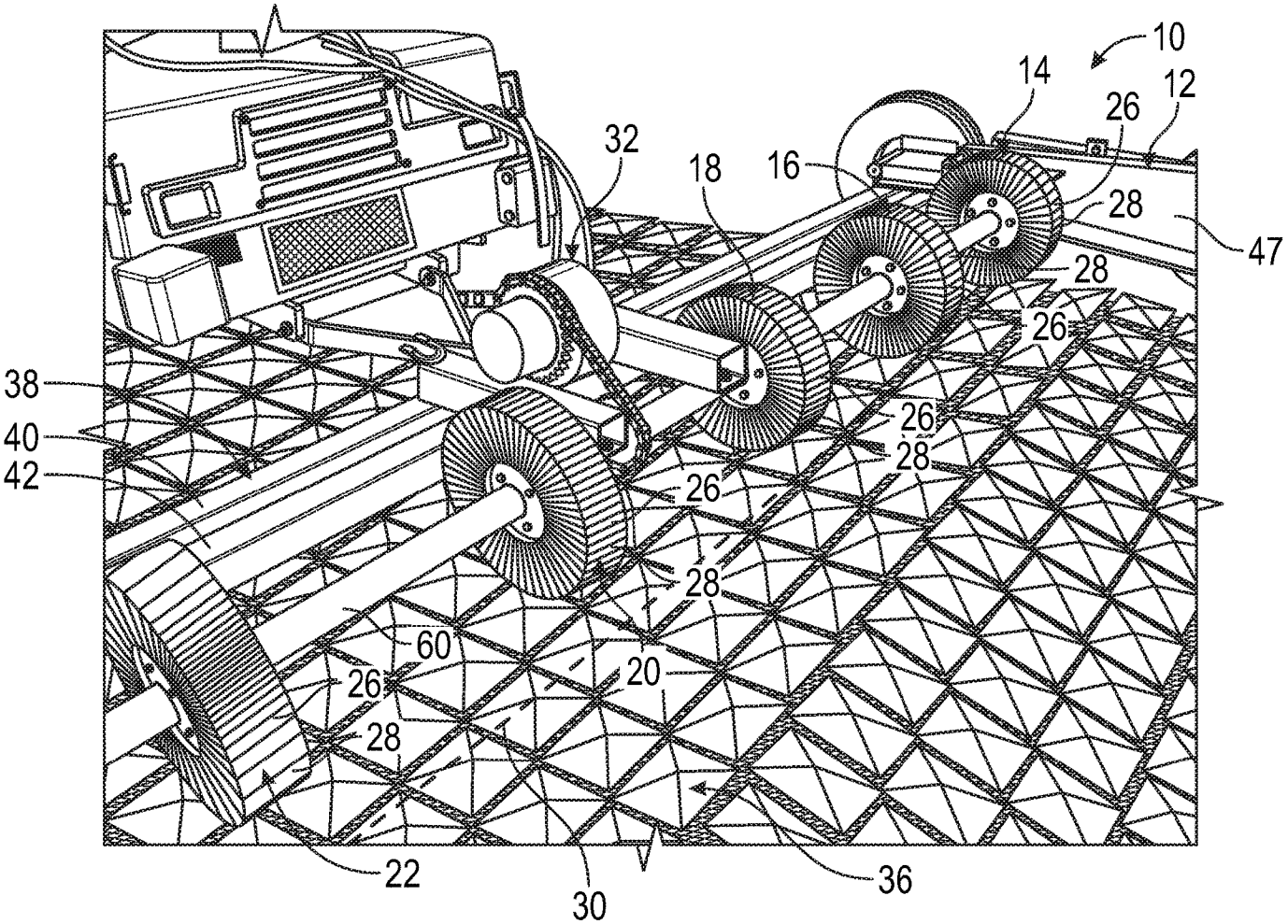
FIG. 3 is a detail perspective view of the system of FIG. 1.

As shown in FIGS. 1 and 2, an exemplary embodiment of the disclosed system for rolling up a flexible sheet, generally designated 10, may include a frame, generally designated 12, and a friction element, which may take the form of individual elements 14, 16, 18, 20, 22, and 24, mounted on the frame. As shown in FIG. 3, one or more, and in an embodiment each, of the plurality of elements 14-24 (only elements 14-22 being shown in FIG. 3) may include an endless friction outer surface 26 having a sheet-engaging portion 28 positioned to engage an end 30 of a flexible sheet 36 lying in a substantially horizontal position relative to the frame 12. In the application depicted in the drawing figures, the sheet 36 may take the form of an erosion-preventing mat of concrete blocks cast into a geo-grid, known as tied concrete block. Such tied concrete block is described more fully in U.S. Ser. No. 62/312,979, filed Mar. 24, 2016, the entire contents of which are incorporated herein by reference. An example of such a tied concrete block product is Flexamat®, sold by Motz Enterprises, Inc. of Cincinnati, Ohio.

The system 10 also may include a drive, generally designated 32, connected to the plurality of elements 14-24 to move the friction elements such that the sheet-engaging portions 28 thereof move upwardly so that the end 30 of the flexible sheet 36 may be lifted up and rolled over on itself to form a roll 34, as shown in FIGS. 1 and 2.

In an exemplary embodiment, the frame 12 may be a moveable frame, such that the frame may move or be moved as the drive 32 moves the endless friction surfaces 26 to roll up an entire sheet 36 into a roll 34 in a continuous operation. In an exemplary embodiment, the frame 12 may include a transverse beam, generally designated 38, which may take the form of a pair of transverse beam elements 40, 42.

Figure 5:
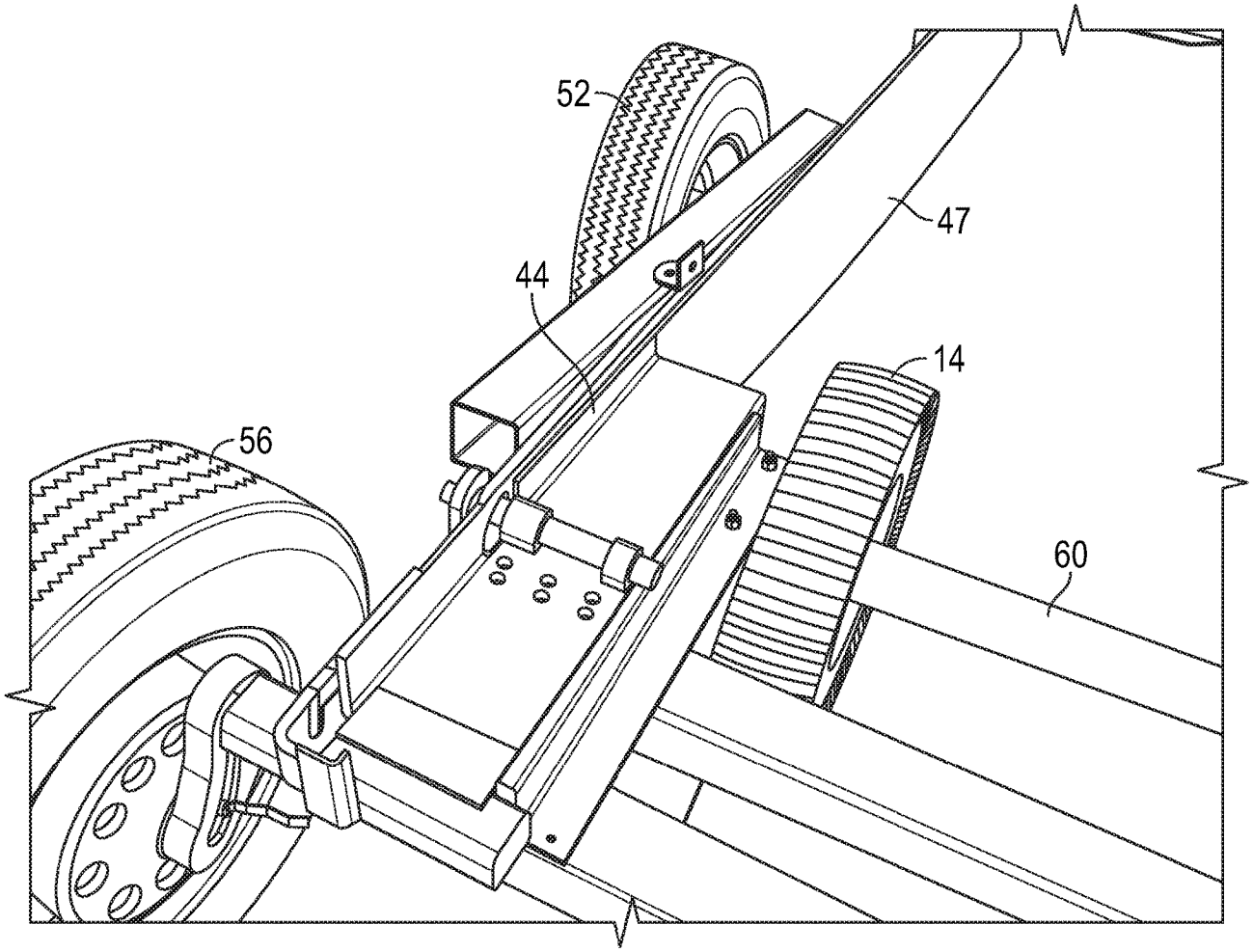
FIG. 5 is a rear perspective view of a detail of the system of FIG. 1.

As shown in FIGS. 1 and 2, the frame 12 may include first and second elongate, opposing guide walls 44, 46. The guide walls 44, 46 may be spaced apart sufficiently to straddle the width of the sheet 36. In an embodiment, the guide walls 44, 46 each may have a flat, inward-facing guide surface 47 (see FIGS. 1, 3, and 5). The guide surfaces 47 may be spaced apart from each other at or just slightly greater than the width of the flexible sheet 36. The frame 12 may include a plurality of support wheels 48, 50, 52, 54, 56, 58 arranged in opposing pairs (48 and 50, 52 and 54, and 56 and 58) and rotatably mounted on outboard sides of each of the first and second elongate guide walls 44, 46. In an embodiment, the support wheels 48, 50 are mounted on the outboard sides of the forward ends (relative to the motion of the frame 12) of the guide walls 44, 46; support wheels 52, 54 are mounted on outboard sides of the guide walls at mid-portions thereof; and support wheels 56, 58 are mounted on outboard sides of the guide walls at rear portions thereof.

In an exemplary embodiment, the plurality of elements 14-24 each may take the form of one of a plurality of friction wheels, which may be round, rotatably mounted on the frame, and the endless friction surface of each of the friction wheels may be an outer periphery of the wheel. In a particular exemplary embodiment, the friction wheels 14-24 may take the form of substantially round, rubber flap wheels. In a more detailed embodiment, one or more of the flap wheels 14-24 may take the form of a laminated wheel, such as Part Numbers 116 (tire) and 117 (flange) for a Model 3414 Bush Hog, manufactured by Bush Hog, Inc. of Selma, Ala. In still other embodiments, one or more of the elements 14-24 may take the form of a rubber tire, or a metal disk, which may be either solid or spoked, and may or may not have a metal band or a flexible friction band around the periphery, or a plastic or metal cylinder or pipe, the endless friction surface thereof which may or may not include a friction material such as rubber or a polymer, such as sprayed-on or painted on, or take the form of a sleeve slipped over the cylinder. In yet other embodiments, one or more of the plurality of elements 14-24 may take the form of an endless belt passing over one or more driven rollers.

Figure 4:
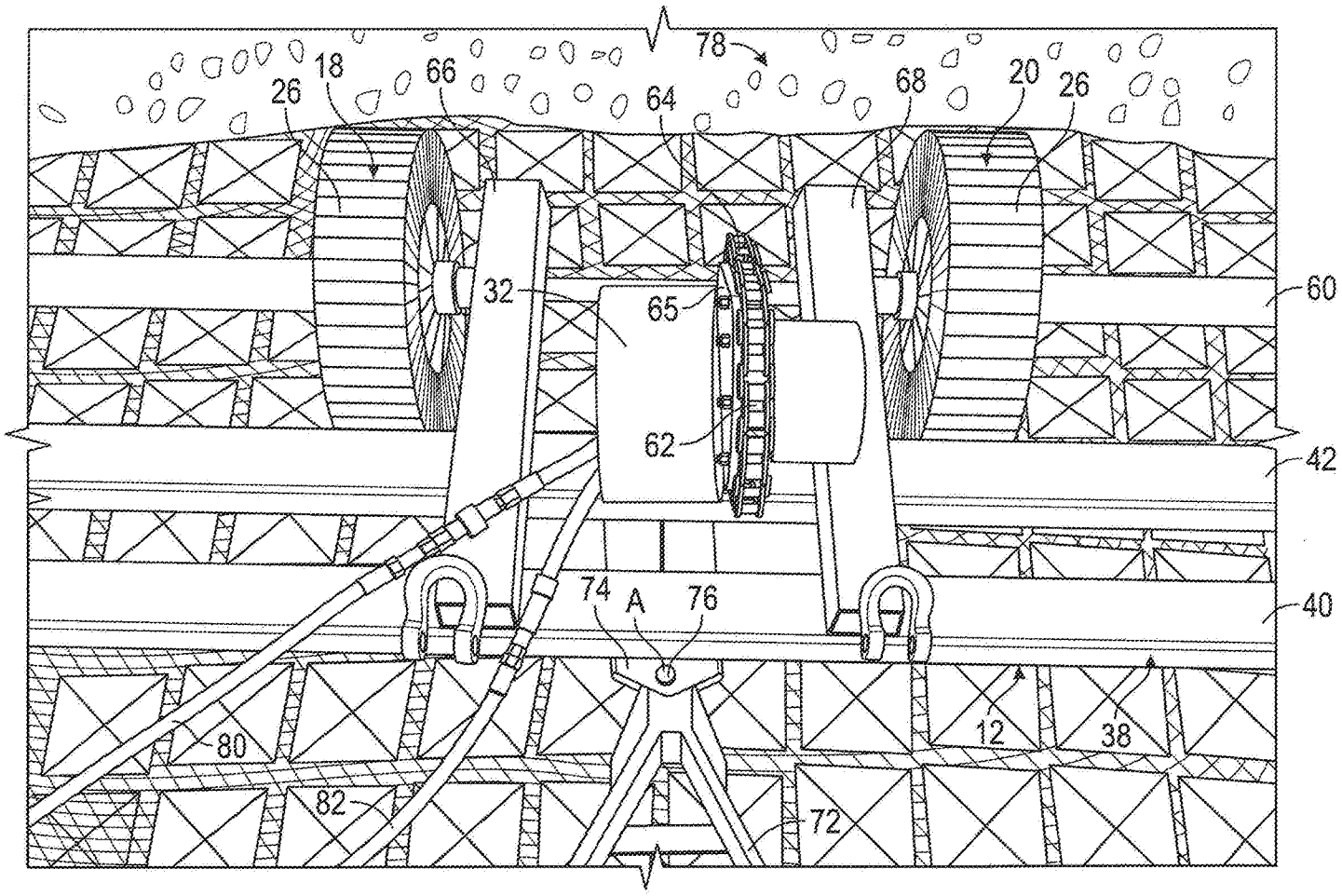
FIG. 4 is a top perspective view of a detail of the system of FIG. 1.

As shown in FIGS. 3 and 4, each of the plurality of friction wheels 14-24 (FIG. 1) may be mounted on and fixed to an axle 60 that may be rotatably mounted on the frame 12. In a particular exemplary embodiment, the axle 60 may be rotatably mounted to inboard surfaces of the first and the second guide walls 44, 46, respectively, and extend transversely of the frame, and is oriented parallel or substantially parallel to the transverse beam 38.

As shown in FIG. 4, the drive motor 32 may be mounted on the transverse beam 38, and in a particular exemplary embodiment, may be mounted on transverse beam element 42. The drive motor 32 may be a hydraulic motor that includes a drive sprocket 62 on an output shaft that is connected by a chain 64 to a driven sprocket 65 that is fixed on the axle 60. In other embodiments, the drive motor 32 may be an electric motor. The axle 60 may be rotatably connected to, and held in place by, a pair of channels 66, 68 that are attached as by welding to beam elements 40, 42 and extend longitudinally of the frame 12. The axle 60 may be attached to the channels 66, 68 by bearings (not shown).

As shown in FIGS. 1 and 2, the system 10 may further include an engine 70 that may take the form of a small tractor, which in some embodiments may take the form of a crawler-carrier. In a particular exemplary embodiment, the engine 70 may take the form of an IC-35 Crawler Carrier manufactured by IHI Construction Machinery Limited of Yokohama, Japan. The engine 70 may provide power, either hydraulic or electric, to the drive motor 32 by way of hydraulic or electric cables, respectively.

The engine 70 may be connected to the frame 12 to move the frame toward the sheet 36 as the drive 32 moves the endless friction surfaces 26 of the plurality of elements 14-24 upwardly, such that the end 30 of the flexible sheet 36 engages the sheet-engaging portions 28 and is lifted up and rolled over on itself to form a roll over the entire length of the sheet. The engine 70 may be connected to the frame 12 at a transverse center thereof to pivot about a vertical axis A shown in FIG. 4. In a particular embodiment, the engine 70 may include a bracket 72, projecting from a center front bumper thereof, that engages a clevis 74 formed at a midpoint of the beam element 40 and is pivotally connected to the bracket 72 by a pin 76. Pin 76 coincides with axis A.

The disclosed method for rolling up a flexible sheet 36 may include first placing the flexible sheet 36 in an unrolled and flat state on a substantially horizontal surface, such as the ground 78 (FIG. 4). It is preferable that the ground be substantially or completely level and free of large debris. The hydraulic motor 32 which is powered by a hydraulic pump (not shown) that in turn is powered by the motor of the engine 70, and is supplied with hydraulic fluid through conduits 80, 82, is actuated to rotate the elements 14-24.

The rotating friction elements are brought into engagement with the end 30 of the flexible sheet 36 by the engine 70, which moves the frame 12 forward, that is, in a direction from right to left in FIGS. 1 and 2. The upward movement of the sheet-engaging portions 28 of the elements 14-24 causes the end 30 of the flexible sheet 36 to curl upwardly over a remainder of the sheet to begin rolling up the flexible sheet into the roll 34 shown in FIGS. 1 and 2. The process continues by moving the plurality of rotating friction elements 14-24 in a direction toward the remainder of the flexible sheet 36, that is, in a direction from right to left in FIGS. 1 and 2, thereby causing the remainder of the flexible sheet to roll up into a spiral configuration. In one specific exemplary embodiment, the process may be initiated by manually folding over an end of the sheet 36, such as one transverse row of tied block, on itself to begin the roll, then bringing the rotating elements 14-24 into contact with the folded over end of the sheet 36. When finished, the roll 34 of coiled sheet 36 may appear as it does in FIG. 6.

Figure 7:
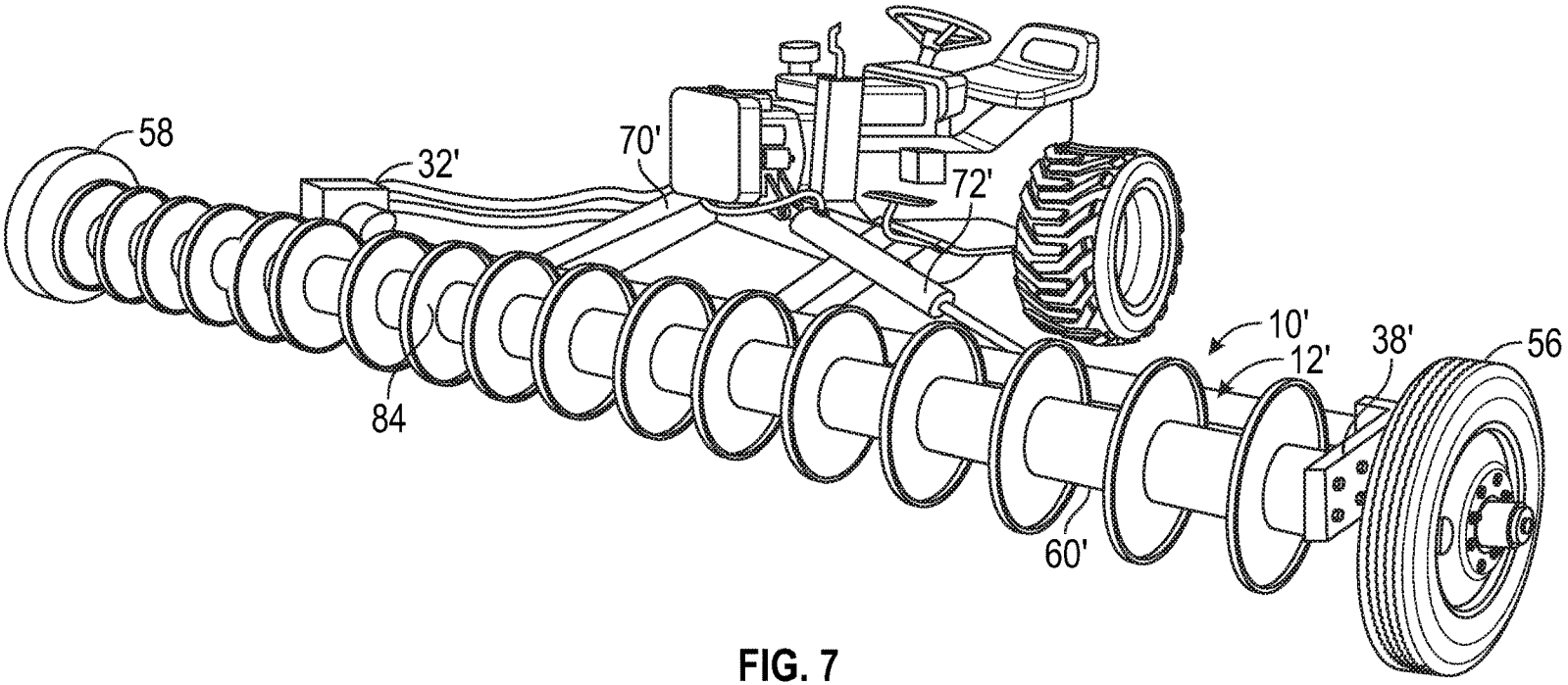
FIG. 7 is a perspective view of another embodiment of the disclosed system for rolling up a flexible sheet.
Figure 8:
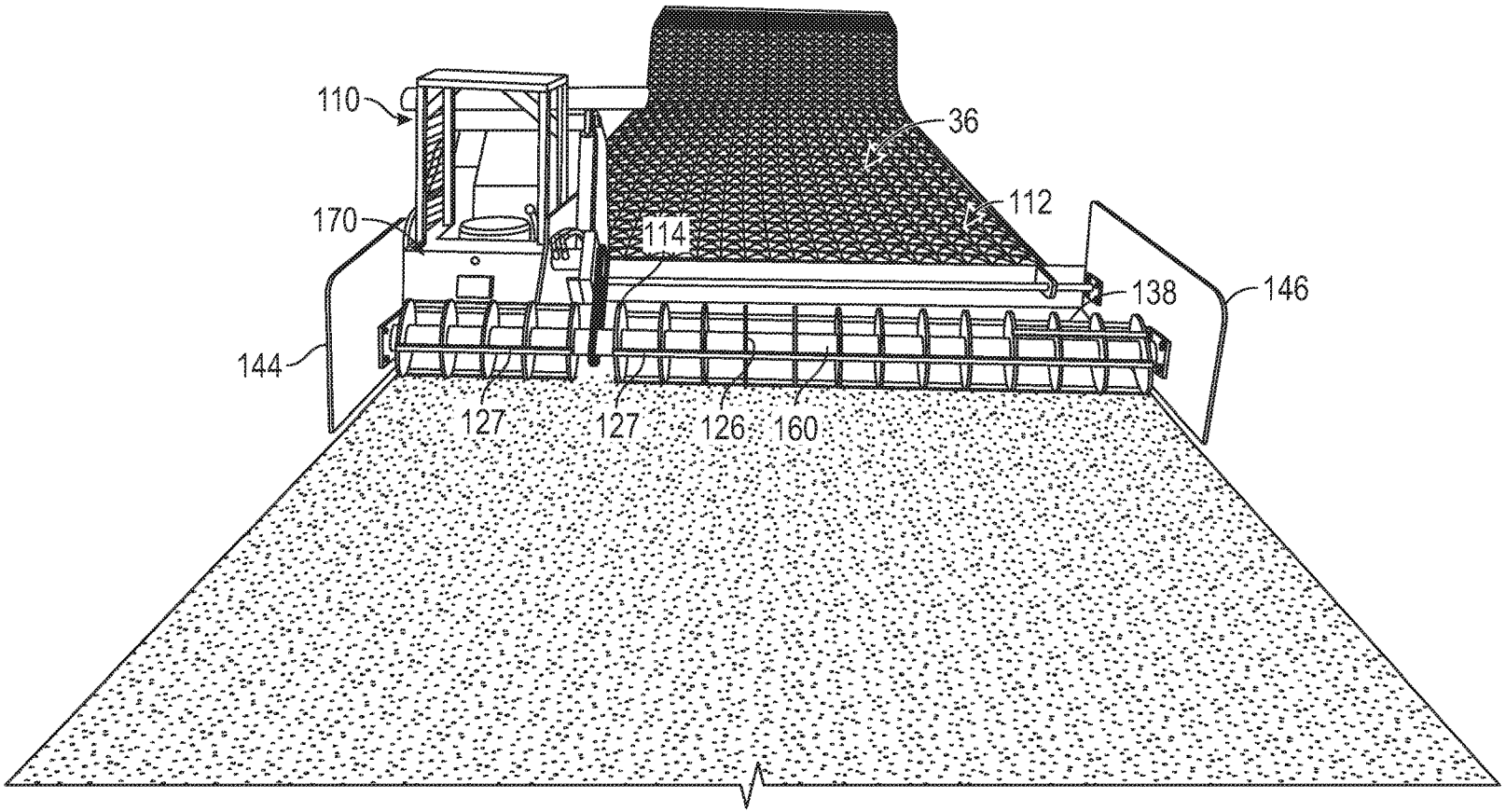
FIG. 8 is a front view of yet another embodiment of the disclosed system for rolling up a flexible sheet.
Figure 9:
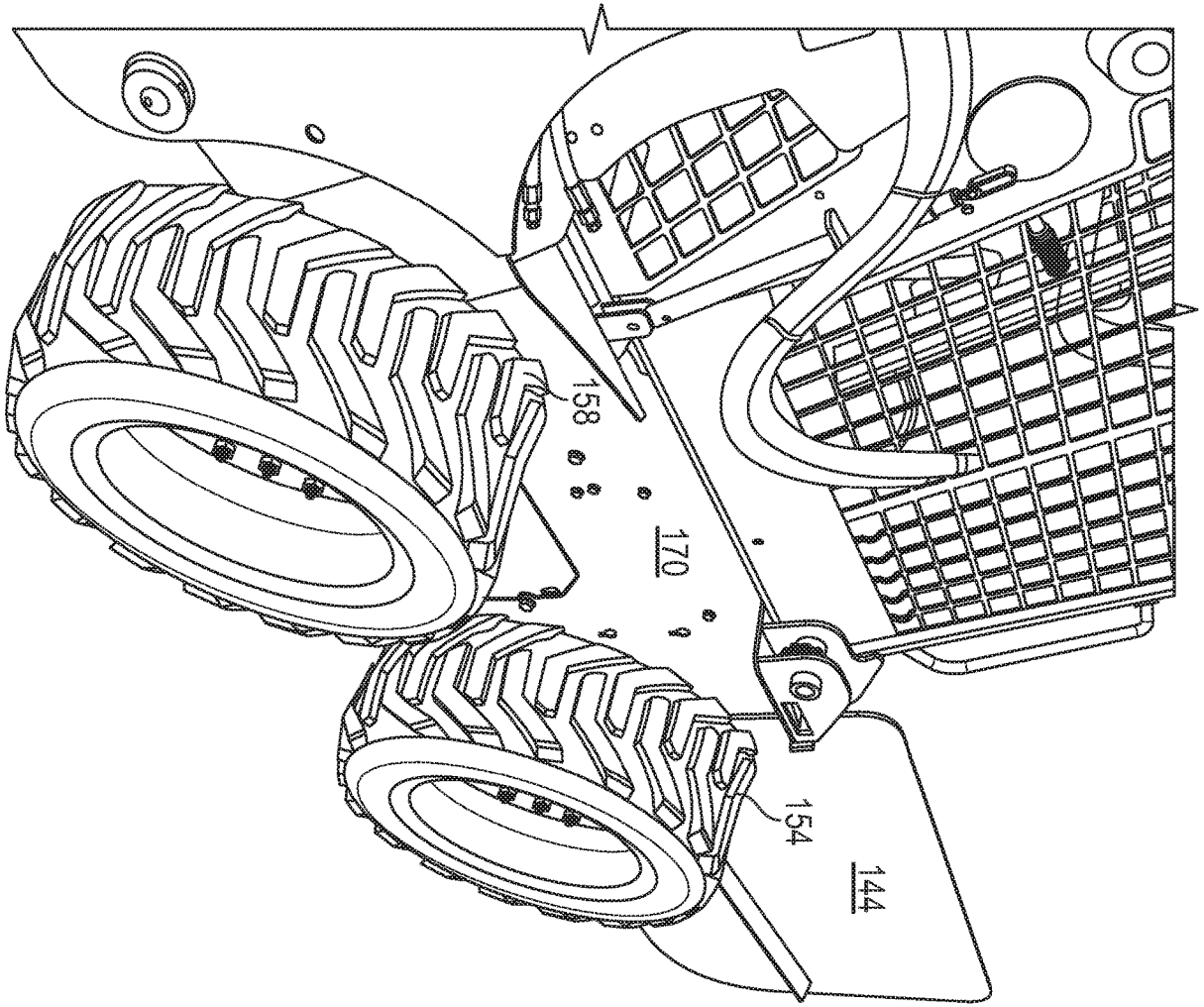
FIG. 9 is a detail of the right side of the system shown in FIG. 8.
Figure 10:
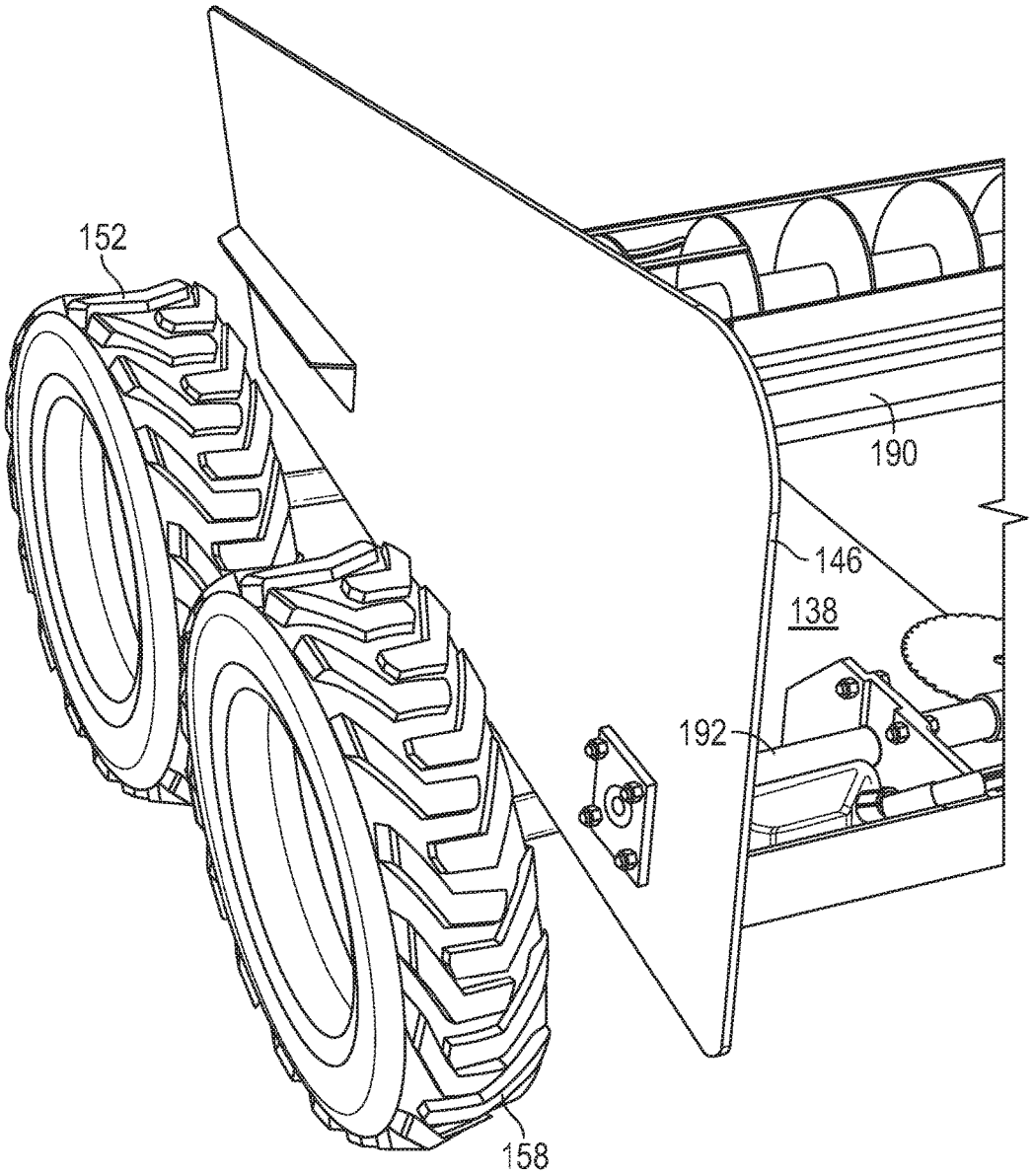
FIG. 10 is a detail of the left side of the system shown in FIG. 8.
Figure 11:
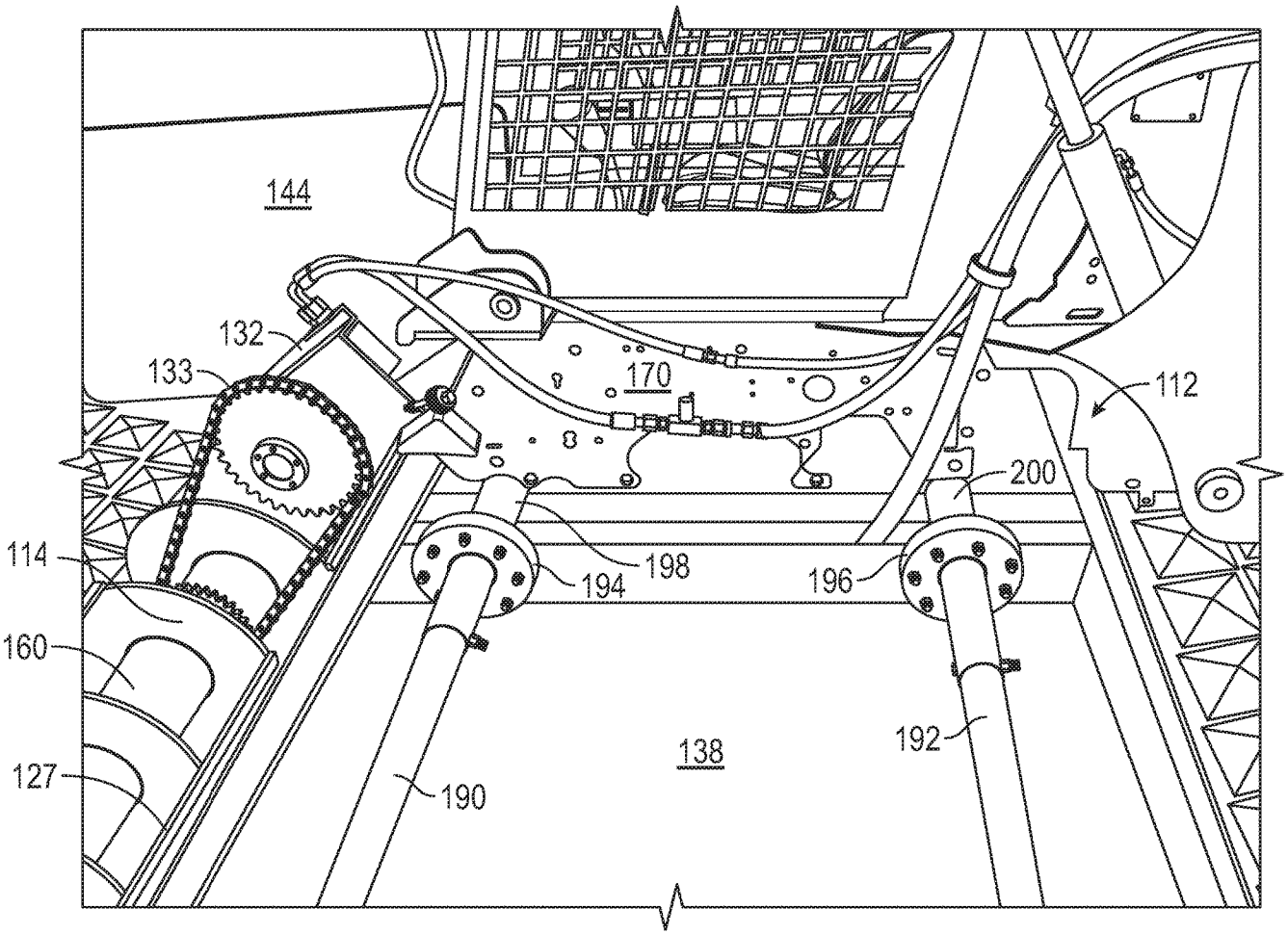
FIG. 11 is a detail side perspective view of the cab and frame of the system shown in FIG. 8.

As the frame 12 is moved forwardly by the engine 70, the roll 34 that is being formed from the sheet 36 is maintained in an aligned configuration; that is, each successive coil of the roll is aligned laterally with the other coils of the roll. This is achieved by constraining the roll 34 between the vertical guide walls 44, 46 of the frame, which prevent the roll from becoming misaligned laterally as it is coiled. In an exemplary embodiment, the alignment of the coils of the roll 34 may be achieved by steering the engine 70 laterally, that is, to the left and/or to the right, to increase or decrease the rate at which the roll is being formed at one or the other ends of the roll 34. By steering the engine in this manner, it may be possible to utilize a frame 12' that does not include the guide walls 44, 46, as shown in an exemplary embodiment of the system 10' in FIG. 7.

Such a frame 12' may be propelled by an engine 70', connected by a bracket 72' pivotally connected to a transverse beam 38' that also supports a drive motor 32' that rotates an axle 60' on which are fixed friction elements 84, which may take the form of metal discs, optionally fitted with metal bands welded to their outer peripheries. The axle 60' may be rotatably attached to the transverse beam 38', that in turn is supported by wheels 56, 58, which are rotatably mounted thereto. The engine 70' may supply power, which in embodiments may be hydraulic power or electric power as required, to the drive 32', which may take the form of a hydraulic or electric motor, respectively.

Another exemplary embodiment of the system for rolling up a flexible sheet, generally designated 110, is shown in FIGS. 8-12. That system 110 may include a frame 112 on which is mounted a friction element that may take the form of a plurality of discs 114. The discs 114 are shown in the exemplary embodiment as solid discs, but in other embodiments may be spoked discs, and in still other embodiments may take the form of a plastic or metal cylinder or pipe, or an endless belt. In exemplary embodiments, the discs may be made of metal, such as steel, or other materials such as plastic or nylon. Each of the discs 114 may have an endless friction outer surface 126 with a sheet-engaging portion 128 positioned to engage an end of the flexible sheet 30 lying in a substantially horizontal position on the ground relative to the frame.

The system 110 may include a drive that may take the form of a hydraulic motor 132. The hydraulic motor 132 may be mounted on and powered by an engine that may take the form of a traction vehicle 170. An exemplary example of such a traction vehicle 170 is a modified skid-steer loader shown in FIGS. 8-12. An example of a modified skid-steel loader is a Bobcat model S175 skid-steer loader, in which the lift arms and bucket have been removed. The traction vehicle 170 may include a transverse beam, generally designated 138, that may take the form of a flat plate with upwardly curved front and rear faces.

The traction vehicle 170 may include first and second elongate, opposing guide walls 144, 146, respectively, spaced apart sufficiently to straddle the width of the sheet 36 to be rolled into a coil. The guide walls 144, 146 each may be plate shaped and made of metal, such as steel. The first guide wall 144 may be attached to or mounted on the traction vehicle 170, as by welding, rivets, or screws. A transverse beam, which may take the form of a flat sheet 138, and which may be made of metal such as steel, with upturned front and rear edges, may be attached, as by welding, at a lateral side edge thereof to a side of the traction vehicle 170 opposite the first guide wall 144. The second guide wall 146 may be attached to an opposite lateral side edge of the flat sheet 138 by welding, rivets or screws.

Figure 6:
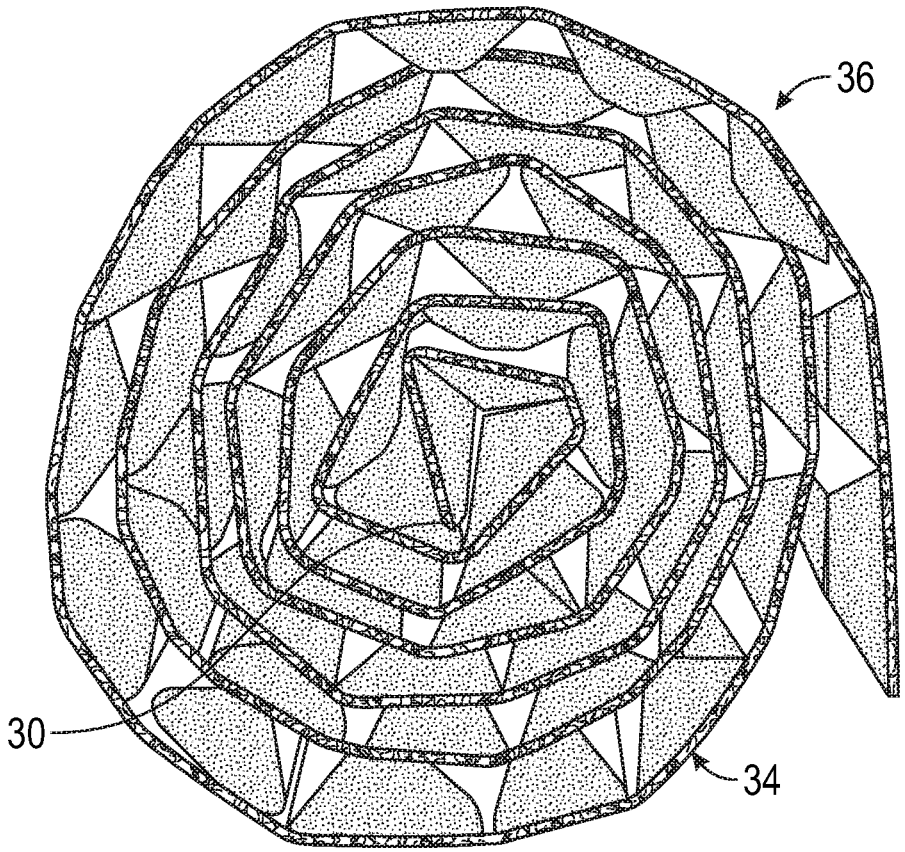
FIG. 6 is a side elevation of a rolled-up sheet of erosion-preventing material.

A drive, that may take the form of hydraulic drive motor 132, may be connected to the friction element discs 114 to move the endless friction outer surfaces 126 thereof such that the sheet-engaging portions thereof move upwardly to engage the end of the flexible sheet 36 and lift up and roll the end 30 of the flexible sheet over on itself to form a roll 34 (see FIG. 6). In an embodiment, the drive 132 may rotate the plurality of discs 114. The discs 114 may be mounted on an axle 160 that is rotatably mounted on the frame 112. Optionally, the endless outer friction surfaces 126 may include elongate bars 127 that extend in an axial direction and are attached to the peripheries of two or more of the discs 114. The bars 127 may be made of metal, such as steel, or a plastic, or carbon fiber reinforced plastic, and attached to the peripheries of the discs 114 by welding or by screws or a suitable adhesive, depending on the materials of the bars and discs. In an exemplary embodiment, the axle 160 may be rotatably mounted at its ends to the inboard surfaces of the opposing guide walls 144, 146 by bearings, and connected to the hydraulic motor 132 by a chain and sprocket assembly 133, such that the motor rotates the axle 160 through the chain and sprocket assembly.

The frame 112 and vehicle 170 may be supported by a pair of front wheels 152, 154 and a pair of rear wheels 156, 158.

Wheels 152, 156 may be mounted on front and rear extension axles 190, 192, respectively, which may be attached by front and rear couplings 194, 196, respectively, to the drive axles 198, 200 of the traction vehicle 170 on which are mounted the front and rear wheels 154, 158, respectively. The front and rear extension axles 190, 192 may be rotatably attached to and supported by front and rear bearing plates 202, 204, respectively, mounted on the sheet 138, and extend through and rotatably supported by the guide plate 146.

Figure 12:
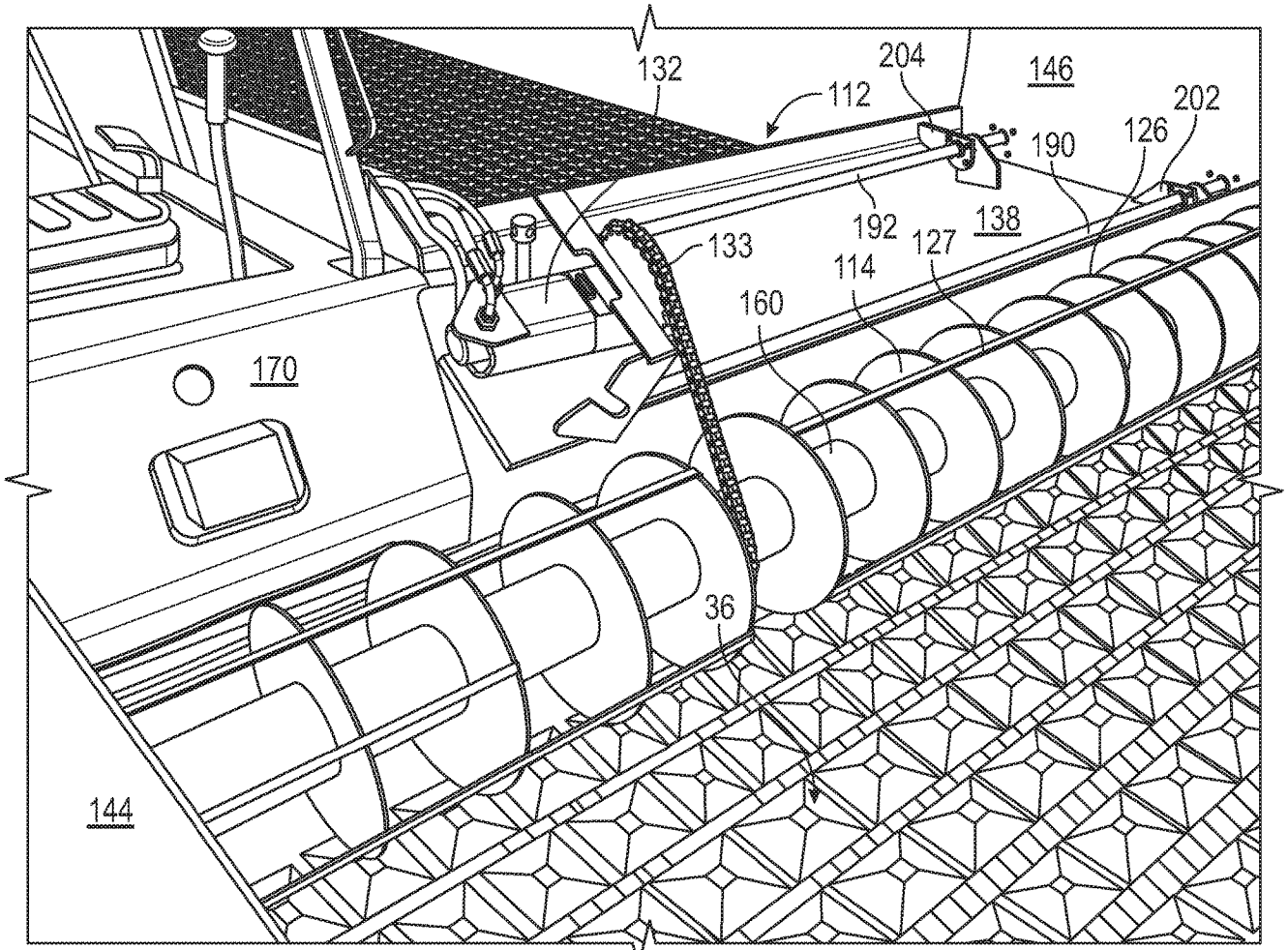
FIG. 12 is a detail front perspective view of the cab and frame of the system shown in FIG. 8.

In exemplary embodiments, the method of rolling up a flexible sheet 36 by the system 10, 10', 110 may include rotating the plurality of friction elements 14-24, and 114 (which may take the form of a plurality of rubber flap wheels or metal discs, the latter optionally fitted with elongate bars 127) in a direction counter to the direction toward the remainder of the flexible sheet 36 (i.e., counterclockwise in FIGS. 3 and 12). Further, rotating the plurality of friction elements 14-24, and 114 may include rotating the shaft 60, 160 mounted on the frame 12, 112 in which the shaft 60, 160 includes the plurality of round friction elements 14-24, and 114 fixed thereto. The movement of the plurality of rotating friction elements 14-24, and 114 in a direction toward the remainder of the flexible sheet 36 may include moving the frame 12, 112 in the direction toward the remainder of the flexible sheet, while the sheet remains immobile relative to the frame and on the ground 78.

The bringing of the plurality of rotating friction elements 14-24, and 114 into engagement with an end 30 of the flexible sheet 36 may include moving the frame 12, 112 on which the rotating friction elements are mounted toward the end of the flexible sheet. As the frame 12, 112 moves to roll up the sheet 36 into a roll 34, successive coils of the roll may be kept aligned with each other because they are constrained by the guide walls 44, 46, 144, 146. The result is the roll 34 shown in FIG. 6. In an embodiment, the method may be initiated by folding over a portion of the end 30 of the sheet 36 on itself, which may present a larger surface to be engaged by the friction elements 14-24, and 114. The remaining coiling may be effected automatically by the system 10, 10', 110.

In an embodiment of the method, the system 10, 110 may be used to roll a sheet, which may take the form of an erosion-preventing laminate mat 36, that is substantially less in width than the space between the guide walls 44, 46, and 144, 146. For example, the space between the guide walls 44, 46 and 144, 146 may be 16 feet, and the mat 36 may be 8 feet in width. In such a situation, a longitudinal edge of the mat 36, such as the right longitudinal edge, may be placed against the guide wall 46, 146 and the mat 36 contacted by and rolled only by those friction elements 20-24 (FIG. 1) that may contact the sheet, while the left longitudinal edge does not contact the guide wall 44, 144, or any other lateral constraint. In this manner, the system 10, 110 may be employed to roll sheets or mats 36 of any width less than the spacing between the guide walls 44, 46 and 144, 146.

In another exemplary embodiment of the method, the system 10, 10', 110 may be used to roll sections of a continuous sheet 36 of erosion-preventing laminate that has been cut into segments that may be on the order of 30 feet. It is also within the scope of the invention to utilize segments up to 80 feet or more. The system 10, 10', 110 may employ the foregoing method to roll an intermediate one of the segments into a coil 34, then, as that coil is being loaded on a truck (not shown), the engine 70, 170 may be reversed so that the system backs up over an adjacent segment and rolls up that segment. The engine 70 then may back up a second time to roll up a segment adjacent the immediately previous segment and roll up that segment as the immediately previous segment is loaded onto a truck. In this fashion, the system 10 may be used continuously to roll up segments cut from a continuous sheet 36 of erosion-preventing mat that are lying end-to-end, without waiting for a rolled up segment of mat to be moved out of the way by loading it onto a truck.

While the systems and methods disclosed and described herein comprise exemplary embodiments of the system and method for rolling up a flexible sheet, it is to be understood that the invention is not limited to these precise systems and methods, and changes may be made therein without departing from the scope of the invention.

What is claimed is:

1. A system for rolling up a flexible sheet on a horizontal surface, the system comprising:

a frame;

a friction element mounted on the frame, the friction element having an endless friction outer surface with a sheet-engaging portion positioned on the frame to engage an end of the flexible sheet lying on the horizontal surface; and a drive connected to the friction element to rotate the endless friction outer surface such that the sheet-engaging portions thereof move upwardly to engage the end of the flexible sheet on the horizontal surface and curl the end of the flexible sheet upwardly back over on itself to form a roll on the horizontal surface.

2. The system of claim 1, wherein the frame is a movable frame, such that the frame is movable as the drive moves the endless friction surface to roll up an entire sheet.

3. The system of claim 2, wherein the frame includes a transverse beam.

4. The system of claim 3, wherein the drive is in the form of a drive motor connected to rotate the plurality of friction elements.

5. The system of claim 4, wherein the drive motor is mounted on the transverse beam.

6. The system of claim 1, wherein the friction element includes a plurality of friction wheels rotatably mounted on the frame, wherein the endless friction surface of each of the friction wheels is an outer periphery of the wheel.

7. The system of claim 6, wherein the friction wheels are selected from a substantially round rubber flap wheel, a rubber tire, a solid or spoked metal disk, a plastic or metal cylinder or pipe, and an endless belt.

8. The system of claim 6, wherein the plurality of friction wheels is mounted on and is fixed to an axle rotatably mounted on the frame.

9. The system of claim 1, wherein the frame includes first and second elongate guide walls spaced apart to straddle the sheet.

10. The system of claim 9, wherein the frame includes a plurality of support wheels rotatably mounted on outboard sides of each of the first and the second elongate guide walls.

11. The system of claim 1, further comprising an engine connected to the frame to move the frame toward the sheet as the drive moves the endless friction surfaces of the plurality of friction elements upwardly, such that the end of the flexible sheet engages the sheet-engaging portions and is lifted up and rolled over on itself to form a roll over an entire length of the sheet.

12. The system of claim 11, wherein the engine is connected to a transverse center of the frame to pivot about a vertical axis.

13. The system of claim 1, wherein the frame is a movable frame having first and second elongate guide walls, a transverse beam connected to the first and second guide walls such that the first and second guide walls are spaced apart sufficiently to straddle the sheet, the frame including wheels supporting the guide walls;

the system further comprises an axle rotatably mounted on the frame and extending between the first and the second guide walls;

wherein the friction element includes a plurality of discs mounted on the axle, the plurality of discs optionally joined at outer peripheries thereof by a plurality of axially extending bars, the outer peripheries of the discs and, optionally, the bars forming the endless friction outer surface;

the system further comprising a motorized cab attached to a side of the frame, the cab having front and rear axles extending across the cab and the frame, each of the front and rear axles having wheels mounted on an outboard side of the cab on one end and on an outboard side of the frame on an opposite end, wherein at least one of the front and rear axles is driven; and wherein the drive includes a drive motor of the motorized cab connected to rotate the axle, the plurality of discs, and optionally the bars and thereby rotate the endless friction outer surface.

* * * * *